US008142372B2

(12) United States Patent
Rastegar et al.

(10) Patent No.: US 8,142,372 B2
(45) **Date of Patent: *Mar. 27, 2012**

(54) EXTERNAL LEFT VENTRICULAR ASSIST DEVICE FOR TREATMENT OF CONGESTIVE HEART FAILURE

(76) Inventors: Jahangir Rastegar, Stony Brook, NY (US); Harry Soroff, Northport, NY (US)

( * ) Notice: Subject to any disclaimer, the term of this patent is extended or adjusted under 35 U.S.C. 154(b) by 1262 days.

This patent is subject to a terminal disclaimer.

(21) Appl. No.: 11/805,421

(22) Filed: May 23, 2007

(65) Prior Publication Data

US 2008/0045866 A1 Feb. 21, 2008

Related U.S. Application Data

(63) Continuation-in-part of application No. 11/009,222, filed on Dec. 10, 2004, now abandoned, which is a continuation of application No. 09/851,930, filed on May 10, 2001, now Pat. No. 6,846,294.

(60) Provisional application No. 60/808,482, filed on May 25, 2006.

(51) Int. Cl.
*A61H 7/00* (2006.01)
*A61H 9/00* (2006.01)

(52) U.S. Cl. ..... 601/9; 601/11; 601/44; 601/152

(58) Field of Classification Search ..... 601/6, 9, 601/10, 11, 41, 43, 44, 148, 149, 150, 151, 601/152; 128/DIG. 20; 602/13
See application file for complete search history.

(56) References Cited

U.S. PATENT DOCUMENTS

| | | | |
|---|---|---|---|
| 2,223,570 | A | 12/1940 | McMillin |
| 2,241,444 | A | 5/1941 | Bower |
| RE24,357 | E | 9/1957 | Emerson |
| 3,043,292 | A | 7/1962 | Mendelson |
| 3,078,842 | A | 2/1963 | Gray |
| 3,368,550 | A | 2/1968 | Glascock |
| 3,859,989 | A | 1/1975 | Spielberg |
| 4,003,378 | A | 1/1977 | Pickering |
| 4,257,407 | A | 3/1981 | Macchi et al. |
| 4,320,746 | A | 3/1982 | Arkans et al. |
| 4,481,938 | A | 11/1984 | Lindley |
| 4,621,621 | A | 11/1986 | Marsalis |
| 4,770,165 | A | 9/1988 | Hayek et al. |

(Continued)

FOREIGN PATENT DOCUMENTS

WO 9628129 A1 9/1996

OTHER PUBLICATIONS

Article on External Counterpulsation, Management of Cardiogenic Shock After Myocardial Infarction, pp. 1193-1202 and Table 1, Jama, Sep. 9, 1974, vol. 229, No. 11, pp. 1441-1450.

*Primary Examiner* — Quang D Thanh
(74) *Attorney, Agent, or Firm* — Lerner, David, Littenberg, Krumholz & Mentlik, LLP

(57) ABSTRACT

The invention provides a treatment for congestive heart failure (CHF) in a patient. At least one pressure applicator is arranged externally around a body segment of the patient. Negative pressure, relative to atmospheric pressure, is applied to the body segment of the patient during cardiac systole using the pressure applicator, thereby reducing ventricular afterload in the patient. The negative pressure to the body segment of the patient is removed during cardiac diastole.

22 Claims, 11 Drawing Sheets

U.S. PATENT DOCUMENTS

| | | | | |
|---|---|---|---|---|
| 4,824,105 | A | 4/1989 | Goldenberg | |
| 5,222,478 | A | 6/1993 | Scarberry et al. | |
| 5,279,283 | A | 1/1994 | Dillon | |
| 5,554,103 | A | 9/1996 | Zheng et al. | |
| 5,562,604 | A | 10/1996 | Yablon et al. | |
| 5,900,299 | A | 5/1999 | Wynne | |
| 5,997,540 | A | 12/1999 | Zheng et al. | |
| 6,846,294 | B2 * | 1/2005 | Rastegar et al. | 601/9 |
| 7,074,200 | B1 * | 7/2006 | Lewis | 601/152 |
| 2002/0115949 | A1 | 8/2002 | Kuslich et al. | |

* cited by examiner

FIG. 9
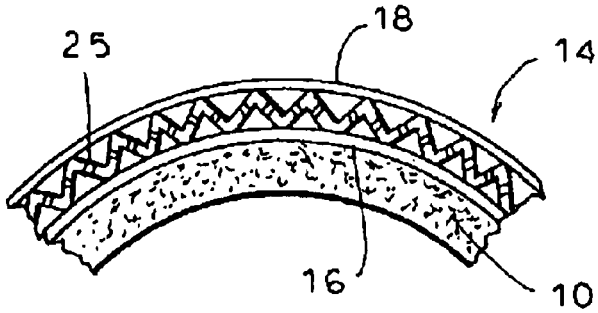
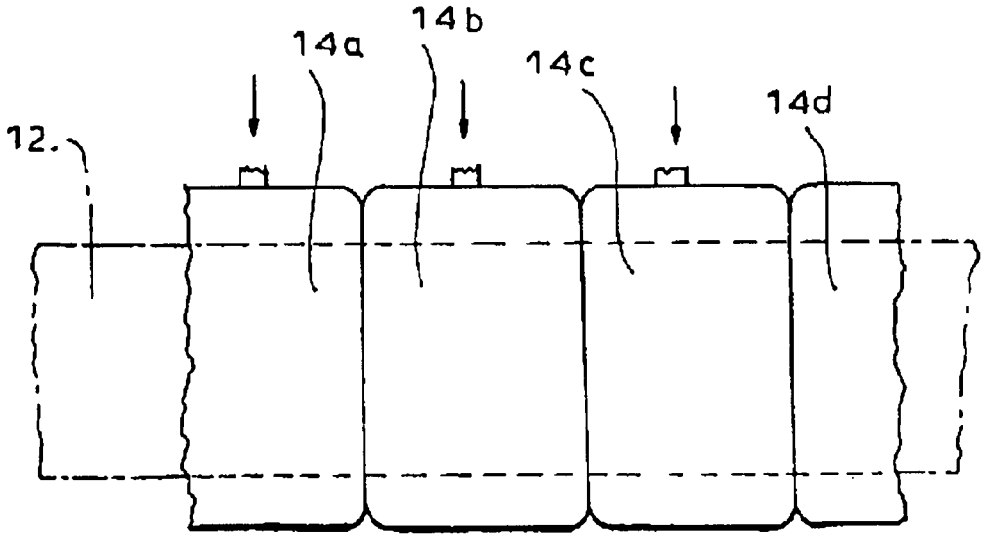
FIG. 10

EXTERNAL LEFT VENTRICULAR ASSIST DEVICE FOR TREATMENT OF CONGESTIVE HEART FAILURE

CROSS-REFERENCE TO RELATED APPLICATIONS

This application is a continuation-in-part of U.S. application Ser. No. 11/009,222, filed Dec. 10, 2004, which is a continuation of U.S. application Ser. No. 09/851,930, filed May 10, 2001, now U.S. Pat. No. 6,846,294, issued Jan. 25, 2005, the disclosures of which are incorporated by reference herein. This application also claims the priority of U.S. Provisional Application No. 60/808,482, filed May 25, 2006, the disclosure of which is incorporated by reference herein.

BACKGROUND OF THE INVENTION

The present invention relates to the treatment of congestive heart failure using an external counterpulsation cardiac assist device which functions by applying positive and/or negative relative pressure to the limbs and more particularly, to the treatment of congestive heart failure using a relatively rigid, sealed housing for applying positive and/or negative relative (to atmospheric) pressure to the limbs in counterpulsation with heart function, which is adapted to be assembled in situ to provide customized fit and which requires reduced pumping capacity.

Congestive heart failure (CHF) has become a major public health problem. It is one of the leading causes of mortality. Approximately more than 5 million persons have CHF; the annual incidence is more than 550,000 cases; and CHF accounts for more than 900,000 hospital discharges a year. (See, "American Heart Association, Heart Disease and Stroke Statistics-2004 Update", Dallas, American Heart Association, 2003.) The goals of therapy for patients with congestive heart failure (CHF) are to return the function of the left ventricle to normal, and to maintain a normal cardiac output. The benefits derived from pharmacologic interventions may be limited and become ineffective as the disease progresses. The implantation of a left ventricular assist device (LVAD) device may involve invasive major surgery, constant maintenance of a pump, and may modify the heart so that if the pump malfunctions the patient may not survive.

Congestive heart failure represents an enormous public health concern and is a leading cause of death. According to the American Heart Association there are an estimated 5 million Americans with congestive heart failure. Each year there are an estimated 550,000 new CHF cases. (See, "Heart Disease and Stroke Statistics-2004 Update", 2003.) It is expected that the number will increase to 10,000,000 by the year 2037, which makes coronary artery disease a leading cause of permanent disability in the US work force. (See, Silver, M., Maisel, A., Yancy, C. W., McCullough, P. A., Burnett, J. C., Francis, G. S., Mehra, M. R., Peacock, W. F., Fonarow, G., Gibler, B., Morrow, D. A., Hollander, J. BNP Consensus Panel 2004; "A Clinical Approach For The Diagnostic, Prognostic, Screening, Treatment, And Monitoring, And Therapeutic Roles Of Natriuretic Peptides In Cardiovascular Disease", Congestive Heart Failure, September-October, 2004, vol. 10, issue 5, supplement 3.)

The incidence of CHF is almost equal among men and women and the annual incidence is approximately 10 per thousand after 65 years of age. However, the incidence is twice as common among persons with hypertension and five times greater among persons who have had a heart attack. The incidence is 1.5 times higher among black men and women than among white men and women. While most of those with CHF are older; some 1.4 million are under 60 years of age.

Congestive heart failure accounts for more than 900,000 hospital discharges a year at a hospital cost of $18.8 billion. The direct and indirect cost of treating this disease has been estimated at $25.8 billion a year. (See, "Heart Disease and Stroke Statistics-2004 Update, 2003".)

The incidence and prevalence of CHF as well as the costs associated with CHF will continue to increase as more cardiac patients live longer with their disease and thereby increase their risk to develop CHF. CHF may be the only form of heart disease that is increasing in the United States. And, it may continue to do so as more and more victims of coronary occlusions survive and their longevity is increased. However, with each such event the heart muscle is further injured and replaced by scar tissue, which decreases the ability of the left ventricle to perfuse the body. Thus, higher survival rates and increased longevity lead to an increased number of people surviving long enough for congestive heart failure to become likely.

Further, the continued growth in the number of older persons in the population will also result in increasing numbers of persons with this disease regardless of trends in coronary disease morbidity and mortality.

In 2001 some 50,000 people died of heart failure and it was a contributing factor in 266,000 deaths. CHF is the first-listed diagnosis in 875,000 hospitalizations and is the number one cause for hospitalization among individuals 65 years of age and older. (See, "Heart Disease and Stroke Statistics-2004 Update, 2003".) The increasing prevalence of CHF and the resultant increase in hospitalizations and deaths have made CHF a major chronic condition in the United States that calls out for more effective treatment modalities that are also cost effective.

In light of the enormity of the CHF market, the last 20 years has seen the development of a wide variety of non-pharmacologic diagnostic and therapeutic devices and procedures. Nevertheless, the patient with heart failure remains inadequately helped. (See, Silver, M., et al.) An overwhelming need for new and better therapies exists.

Mechanical support of the failing left ventricle can be accomplished in two known ways. One known approach is the use of implantable mechanical devices to support circulation. These devices are usually aimed at the left ventricle (i.e., LVAD's) and have been primarily used for temporary short-term circulatory support and as a bridge to cardiac transplantation. The LVAD requires surgery to the heart to insert the device, and if the LVAD fails, support for the patient's heart is lost and leads to death of the patient. In addition, LVAD's have encountered the problem of blood clotting. At the same time, experience with LVAD's has shown success with some patients in the building of collaterals and the improvement of ventricular function to the point where some have not required heart transplants. This effect is most likely due to the reduction of afterload.

As pointed out above, support of the failing left ventricle can be accomplished by one of two approaches. In the first, an implanted pump removes the blood from the left ventricle and then returns it to the aorta as is the case with the left ventricular/aortic assist devices (LVAD). The second known approach is based on the studies by Soroff et al., that showed that when the pressure against which the left ventricle must work to eject its blood is lowered, the oxygen requirements and work of the left ventricle are significantly reduced. (See, Soroff, H S., Levine, H J., Sachs, B F., Birtwell, W C., Deterling, R A., "Effects of Counterpulsation on Left Ventricular Oxygen Consumption and Hemodynamics", Circulation, Volume XXVII, April 1963.) This proved that if the pressure in the aorta (afterload) is reduced, the left ventricle can do the same work with less energy consumption. The equipment developed for the above studies, however, was invasive. The equipment utilized a cannula in the femoral artery to withdraw blood rapidly and return it. This method resulted in a great deal of hemolysis and was soon abandoned.

In 1967 the research group at Tufts University created a system that could produce a negative pressure of −50 mm Hg during cardiac systole as well as a positive pressure during cardiac diastole. The addition of the negative pressure phase enabled the system to assist patients with compromised or failing left ventricles. This system capable of producing negative pressure was evaluated in the treatment of 20 patients with severely compromised left ventricles and cardiogenic shock following myocardial infarctions. This treatment resulted in a significant reduction in the mortality rate for this group of patients. (See, Soroff H S, Cloutier C T., Birtwell W C., Begley L A., Messer J V., "External Counterpulsation-.Management of Cardiogenic Shock After Myocardial Infarction", J JAMA, 1974, 229(11), 1441-50.)

The second goal is to bring about an increase in cardiac output. This may result from an increased venous return. The positive pressure applied by the ELVAD may be minimal during the acute phase of the illness, and may gradually be increased to +50 to +100 mmHg. As the patient improves, the goal of increasing cardiac output to 20% over the pretreatment levels may be easily achieved as a result of increased venous return working in tandem with the decreased left ventricular afterload. This increase in cardiac output of 20% may significantly improve the patient's ability to perform the tasks of daily living.

A known method of assisting the circulation without invading the vascular system by the external application of intermittent pressure to the body has been known. Studies have shown that application of a positive relative pressure pulse to the lower extremities during cardiac diastole can raise the diastolic pressure by 40% to 50% while the application of negative relative pressure (vacuum), during cardiac systole can lower the systolic pressure by about 30%. Hereinafter, by "relative" pressure, it is meant relative to the atmospheric (gauge) pressure.

This externally applied positive and negative relative pressure increases the venous return to the heart because of the unidirectional valves in the peripheral venous bed. In cariogenic shock accompanied by myocardial ischemia, the increased coronary flow may improve cardiac function and thus indirectly affect the hemodynamic response to this procedure. Further, it is believed to promote the growth of collateral channel blood vessels feeding heart tissue and to reduce the symptoms of angina.

The therapeutic results of the known methods are well documented. However, as a practical matter, the apparatus used to externally apply positive and negative relative pressure to the limbs has been extremely inefficient and therefore the procedure has not found wide acceptance.

Early apparatus employed for this purpose included a prefabricated hinged conical metal housing or shell housing. Within the housing, a hollow cylindrical inflatable rubber balloon-like tube was placed, within which the limb segment was situated. The balloon-like rubber tube was filled with water, which was pressurized to inflate the tube, thereby filling the interior of the housing and applying pressure to the surface area of the limb segment.

To apply negative relative pressure, the water was first pumped out of the rubber tube, leaving an air gap between the rubber tube and the limb. An impermeable, rubber-like coated fabric was placed around the exterior of the housing, and was sealed around the limb to trap the air between the limb and the rubber tube. By pumping out the air trapped within the sealed fabric, the fabric first collapsed around the housing, and then negative pressure began to form within the gap between the limb and the rubber tube.

This system had numerous operational difficulties. Due to high resistance to flow, it was nearly impossible to pressurize the rubber tube and pump the water out of the rubber tube fast enough to match the heart beat. As the result, even the process of applying positive relative pressure was very difficult. The process was made even more difficult since a prefabricated housing could not be made to closely fit every patient, therefore a relatively large gap was left between the rubber tube and the limb to be filled by the expanding rubber tube. The amount of air that had to be pumped out of the rubber-coated fabric enclosed space around the housing and in between the limb and the rubber tube was relatively large, thereby requiring large air pumping action. In addition, due to the flexibility of the rubber-coated fabric, it would tend to deform and enter the space between the limb and the rubber tube, thereby making it difficult to achieve the desired level of negative pressure (vacuum) around the limb.

Current applicators utilize a prefabricated and relatively non-extensible fabric within which a balloon-like element is located. The balloon-like element with its enclosing housing or cuff is wrapped around the limb and secured by straps equipped with hook and loop tape, commercially known as VELCRO. Such applicators are currently available from Vassmedical, Inc. of Westbury, N.Y.

During its operation, the balloon is pressurized by air, thereby applying pressure to the surface of the enclosed limb. Due to the bulging and deformation of the cuff as the balloon is pressurized, a relatively large volume of air is required to achieve the required limb surface pressure. This is the case even though the cuff material is relatively non-extensible and the cuff is applied snugly to the limb segment. As the result, large capacity pumps are required to drive the apparatus because of the large volume of air which has to be rapidly moved in and in most cases out of the balloons, to alternatively inflate and deflate the balloons, to apply the required pressure to the limb. This and all variations of such applicator designs that use balloons to apply pressure, cannot be used to apply relative negative pressure to the limb. Another disadvantage of the current applicators is that due to the requirement of a large air volume, the system is rendered non-portable, and hence cannot be made available outside a fixed treatment room and cannot be available in emergency situations.

An attempt has recently been made to develop design concepts with a rigid or semi-rigid outer shell which surround an inflatable balloon-type interior. An applicator of this type is illustrated in U.S. Pat. No. 5,554,103 issued Sep. 10, 1996 to Zhang, et al. and U.S. Pat. No. 5,997,540 issued Dec. 7, 1999 to Zhang, et al., both of which are owned by Vasomedical, Inc. of Westbury, N.Y. Those applicators are described to be wrapped around the limb and held in place with some means such as straps of VELCRO. However, such prefabricated applicator designs cannot closely fit the limb and thus still require a large volume of air to provide the required limb surface pressure level. This is the case since such prefabricated applicators cannot be made to precisely fit a limb segment, thereby leaving a significant dead space between the balloon-like tube and the limb.

The aforementioned patents propose to fill the dead space by spacers to reduce the amount of air required for the operation of the applicator. These spacers have to be cut in various shapes and thicknesses and therefore are highly cumbersome and impractical.

The outer shells and applicators may be custom made to fit the limb segments. A large number of applicators of various sizes and shapes may also be fabricated to nearly accommodate the contour of the limbs of various patients. Custom made applicators are obviously impractical. The fabrication and hospital inventory of a large number of applicators of different sizes and shapes suitable for a wide variety of different size patients is also impractical.

In addition, since such applicators operate by pressurizing balloon-like tubes around the limb segment, they cannot be used to apply negative relative pressure to the limb segment.

SUMMARY OF THE INVENTION

The present invention overcomes these disadvantages through use of a uniquely designed applicator housing with an internal air distribution system. The applicator is custom fit to the limb and therefore requires much less air volume to operate than prior art applications. Since less air volume is needed to operate the housing, much smaller capacity, much lighter and less expensive air pumps are required. Because the applicator housing is assembled in situ from deformable components which are rigidified as they are secured on the patient, and thus can be customized for each patient, the necessity of inventorying large numbers of prefabricated housing components is eliminated while, at the same time, the preciseness of the fit for each individual patient is greatly enhanced.

The amount of air volume required is reduced because the gap between the shell and the limb surface can be made very small, thereby minimizing the total space which must be pressurized. The main limitation in employing such a small gap between the shell and limb surface is the resistance to the air flow in and out of the shell. However, air flow is readily enhanced by the internal air distribution system of the shell and by employing multiple air inlets to the shell.

Further, by minimizing the volume of air required, substantially the same air can be rapidly pumped in and out of the housing to generate positive and/or negative relative pressures in a relatively closed system. This provides an efficient means to control the air pressure, and also permits the air temperature to be closely controlled. Controlling the temperature of the air is important because warmer air promotes vascular dilation, resulting in greater blood flow and hence more efficient operation of the apparatus.

In addition, due to the use of a relatively rigid shell with an internal air distribution system, the inflatable balloon-like interior of the prior art systems is eliminated. This permits the applicator of the present invention to apply both negative and/or positive relative pressure to the limb. The Vasomedical applicators, for example, cannot apply negative relative pressure.

The present invention preferably provides an external counterpulsation cardiac assist device with applicators capable of applying positive and/or negative relative pressure to the limb.

The present invention preferably provides a counterpulsation cardiac assist device with an applicator that requires a relatively small air volume to operate, and hence reduced pump capacity.

The present invention preferably provides an external counterpulsation cardiac assist device which eliminates the use of an inflatable balloon-like tube.

The present invention preferably provides an external counterpulsation cardiac assist device which includes a positive and/or negative relative pressure applicator which can be assembled in situ, and thus customized to precisely fit the limb of each patient.

The present invention preferably provides an external counterpulsation cardiac assist device that is significantly lighter than the existing systems, thereby making it portable such that it can be moved to the patient, rather than requiring the patient to go to a specially equipped facility for treatment.

The present invention preferably provides an external counterpulsation cardiac assist device that is preferably used in which the air temperature can be readily controlled to promote vascular dilation.

The present invention preferably provides an external counterpulsation cardiac assist device having an applicator with a relatively rigid shell that can be readily secured to the limb segment while sealing the applicator inner chamber around the limb segment.

The present invention preferably provides an external counterpulsation cardiac assist device that is preferably used with an air permeable, inner layer covers the limb segment over which a relatively rigid shell is secured and sealed.

The present invention preferably provides external counterpulsation cardiac assist device including a positive and/or negative relative pressure applicator with a rigid or semi-rigid shell having an internal air distribution system within the sealed exterior shell, which is spaced apart from the limb surface by radial and/or longitudinal elements defining a tubular chamber adapted to be connected to a pumping system functioning to move air into and out of the chamber, in synchronization with the operation of the heart.

The applicator of the present invention provides positive relative pressure application and/or negative relative pressure (vacuum) application to the limb by pressurizing and developing a vacuum within the sealed interior of the housing. The shell which defines the interior of the housing is sufficiently rigid and non-expandable, once secured around the limb, so as to contain the positive pressure and sufficiently non-collapsible to permit a significant vacuum to be developed.

In one embodiment of the present invention, the interior shell wall is spaced from the exterior shell wall by radial and/or longitudinal elements so as to define a tubular chamber. The chamber is adapted to be connected to a pump that moves air into and out of the chamber, in synchronization with the operation of the heart.

The shell is preferably initially deformable so that it can be fashioned to closely conform to the shape and size of the limb. Once in place, the interior of the shell is sealed. The shell becomes relatively rigid once it is secured.

An inner layer is preferably situated within the shell interior, adjacent to the limb. This layer is preferably made of highly air permeable material, such as fabric, felt or sponge-like materials, which are flexible in bending but relatively resistant to pressure, i.e., not readily compressed under pressure.

The shell components are preferably initially separate from the permeable inner layer. The tubular space between the walls of the shell defines an internal air distribution system which allows free flow of air between the pump and the permeable inner layer within the shell interior. The permeable inner layer is designed to provide minimal resistance to the air flow.

The positive and/or negative relative pressure cycle and its time profile is preferably controlled by a microprocessor based computer system which receives input from an electrocardiogram or other heart function monitoring device. The positive relative pressure may be provided by an air compressor, a pressurized air tank and/or an air pump. Negative relative pressure can be provided by a vacuum pump. However, a spring-loaded pump mechanism which provides positive and/or negative relative pressure, as described below, is preferred.

In accordance with one aspect of the present invention, an external counterpulsation cardiac assist device is described for providing positive and/or negative relative pressure to a segment of the body in synchronization with the operation of the heart. The device includes a housing. The housing includes a relatively rigid tubular shell surrounding the body segment and an air permeable flexible inner layer situated within the shell interior, proximate the body segment. Means are provided for sealing the shell interior. The shell has an internal air distribution system which operably connects the air supply and the shell interior.

The shell is preferably formed by spaced interior and exterior walls. Spacing means are interposed between the shell walls, defining an air chamber therebetween. The interior shell wall has a plurality of openings facilitating free flow of air between the chamber and the shell interior.

One or more ports in the exterior shell wall are provided. These ports operably connect the chamber and an air supply.

The spacer means separates the internal air chamber of the shell into sections. Air passages are provided through the spacer means to connect the chamber sections. The spacer means can have radially or longitudinally extending spacer walls. Other shapes, such as honeycomb or the like, are useable as well, depending upon the configuration.

The interior shell wall and the spacer means are preferably joined to form an assembly. The exterior shell wall is situated over the assembly. Means are provided for securing the exterior shell wall over the assembly to rigidify the shell.

The interior shell wall is preferably composed of relatively rigid material such as a sheet of plastic or hard rubber, or of a plurality of articulately connected sections of plastic or the like or metal sections.

The inner layer is preferably comprised of fabric, felt or sponge like material. The layer is hard enough to resist the pressure of the interior shell wall during the assembly of the applicator, but is flexible enough not to provide significant resistance to the expanding limb during the application of the negative relative pressure. The material is also flexible enough for significant bending so as to be readily formed to the shape of the limb during the assembly.

The exterior shell wall is air impermeable and preferably composed of flexible but non-extensible sheet material, such as various types of sealed fabrics or plastic.

The interior shell wall and spacer means are preferably integral. Alternatively, both the shell walls and the spacer means may be integral.

The means for sealing the shell over the inner layer preferably comprises sealing tape. The means for securing the exterior shell wall preferably comprises straps or bands which are relatively non-extensible.

The exterior wall may be kept in position relative to the top of the spacers by sections of hook and loop tape or simply by friction enhancing roughened surfaces. In such cases, the top surfaces of the spacer walls may be enlarged to enhance the securing action.

In another preferred embodiment of the present invention, the shell consists only of an exterior wall. No interior wall is used. An air permeable flexible inner layer is placed over the body segment. Spacer means separate the air permeable inner layers from the exterior shell wall, forming an interior air chamber. The spacer means separates the internal air chamber of the shell into sections. Air passages are provided through the spacer means to connect the chamber sections. The spacer means can have radially or longitudinally extending spacer walls. Other shapes, such as honeycomb or the like, are usable as well.

As in the previous embodiment of the present invention, means are provided for sealing the shell interior. The internal air distribution system of the shell operably connects the air supply and the shell interior. One or more ports in the exterior shell wall are provided to operably connect the shell interior chamber and the air supply.

The spacer means and the exterior shell wall may be integral. Alternately, the spacer means and exterior shell wall may be separate, in which case the spacer means is cut and assembled around the air permeable flexible inner layer. The exterior wall is then situated over the assembly. Means are provided for securing the exterior shell wall over the assembly to rigidify the shell.

The inner layer described in the previous embodiment may or may not be utilized in this preferred embodiment. If it is not used, the spacer means are situated proximate the body segment.

Throughout this specification, the present invention is described for purposes of illustration as being air driven. While air is the preferred fluid for many reasons, including low viscosity, non toxicity, non flammability, availability, etc., it should be understood that other gases or liquids could be used.

Another aspect of the invention is to provide non-invasive device that may produce the same physiologic benefits for the heart and the circulation as the invasive devices without their shortcomings.

Here, a number of embodiments are disclosed that provide an effective, in-series, pump to assist the pumping action of the left ventricle. As a result, the left ventricle muscles have to work against a significantly reduced load (so-called afterload). The device of the present invention may be positioned and operated external to the patient's body, thereby avoiding invasive surgery and implantation of artificial assistive devices that suffer from all the consequences of implanting any device into the human body, as well as the problem of providing power (usually electrical power) to the device. The present invention is externally positioned and operated, it is hereinafter referred to as an External Left Ventricular Assist Device (ELVAD).

The technique or method of the present invention is based on assisting pumping action of the left ventricle by applying negative pressure to the lower extremity and/or buttock muscles during cardiac systole. In one embodiment of the present invention, a moderate positive pressure may be also applied to the same muscle(s) during cardiac diastole, to enhance the effectiveness of the ELVAD in its blood pumping action in series with the left ventricle. In addition, many cardiac patients also suffer from vascular disease that renders their arteries less elastic. In such patients, the application of a modest amount of positive pressure may also assist the affected arteries to return to their near normal condition following the application of the negative pressure.

The application of negative pressure to reduce ventricular afterload represents an innovative approach to the treatment of CHF. As indicated later in this disclosure, it has substantial advantages over other types of cardiac assist devices such as implantable Left Ventricle Assist Devices (LVAD's) that are currently on the market.

The present device may be used for treatment of NY Heart Classification III and IV (Stages C/D) congestive heart failure patients. Its unique design ensures its adaptability to the treatment of different stages of CHF. For example, the initial treatment of severe left heart failure may involve exerting high negative pressures during systole, allowing the compromised left ventricle to use less energy while it is pumping and producing the physiologic effect of relieving the pulmonary congestion. Later in the course of treatment, as the patient recovers, and the pulmonary congestion has been brought under control, the synchronous positive pressure during diastole may be increased in order to enhance the development of collaterals and improve cardiac function.

Achievement of these physiological goals can result in improved mobility, exercise tolerance, quality of life, and mortality for CHF patients. Furthermore, the device of the present invention may be configured as a portable device, which would make it possible for patients to be treated as frequently as needed at home. As is to be appreciated, the present invention may have broad societal benefits that would accrue from a more effective CHF treatment which may include the reduction of hospitalizations and reduction in health care costs.

The embodiments of the present invention may involve use of pressure/vacuum applicators that are mounted around one or more of the limbs, such as the legs, thighs, and/or buttocks using various techniques. The operation of these embodiments is timed so that as cardiac systole begins, the application of the aforementioned negative pressure has reduced and preferably continues to reduce the blood pressure downstream to the left ventricle, so that the left ventricle can more efficiently eject its content against a significantly reduced resistance.

The exertion of negative pressures such as approximately −30 mm Hg to −50 mm Hg may achieve significant reductions in ventricular afterload. The actual levels of the negative pressure suitable for a CHF patient may depend on various parameters, such as the severity of the patient's heart condition, the vascular condition, the physical condition of the patient including the muscle mass and the surrounding tissues, and the amount of positive pressure that can safely be applied during cardiac diastole. The range of positive pressure to be applied may also be dependent on various parameters, such as the aforementioned parameters. A range of positive pressure such as +50 mm Hg to +100 mm Hg during diastole can probably be expected for patient with CHF symptoms. For such patients, reduction in systolic pressure by 20-25% is expected to be readily achievable with the present method and embodiments.

The negative pressure during systole may have two effects. The first may ensure that the left ventricle empties itself more completely which will promote more normal circulation throughout the body and, thus, enable the patient with CHF to be more able to perform normal daily activities. Second, the more complete emptying of the left ventricle corrects the "congestive" aspects of congestive heart failure since it facilitates removal of excess fluid from the lungs, which then enables the patient to breathe better.

The positive pressure produced during cardiac diastole, in addition to the aforementioned purpose of enhancing the performance of the device in reducing the left ventricle load, may also have the following two effects, one on the arterial circulation and one on the venous circulation. First, for patients who also suffer from angina because of inadequate coronary flow, the positive pressure may relieve this symptom, by increasing coronary blood flow, and positive pressure has been shown to promote the growth of collateral channels, which results in more normal coronary flow. Second, the positive pressure on the venous system may increase the venous return to the heart resulting in an increase of cardiac output. This may ensure that a mean acceptable blood pressure may be maintained since some CHF patients may have low blood pressure. It may also ensure adequate blood flow to the regional vascular beds of organs such as the kidney and the liver.

The present invention is highly significant because of at least the following: First, the prevalence and incidence of congestive heart failure (CHF) as one of the leading causes of mortality has made it a priority to develop a more effective treatment. Second, there is a need for a less invasive device, particularly an external treatment device that overcomes the limitations of current devices as described below.

Moreover, the risks with invasive LVAD surgery and subsequent maintenance may far exceed those of the present noninvasive ELVAD device. Failure of the present ELVAD device, if it should occur, may merely result in the patient's heart returning to its pretreatment state. Further, the present ELVAD technique may be performed only periodically whereas the LAVD is implanted and may require continuous attention and monitoring.

The present ELVAD embodiments provide an entirely different approach to treating CHF and may treat patients with congestive heart failure by reducing the left ventricle afterload. They may overcome the limitations of the currently available devices by significantly decreasing the work of the left ventricle as a result of reducing ventricular afterload.

The present ELVAD devices may include a number of applicators adapted to be placed around the lower extremities and buttocks that will apply sequential predetermined pressures, such as in the order of about −50 mm Hg to +100 mm Hg, synchronous with cardiac systole and diastole respectively. The negative pressure during systole may decrease the afterload of the left ventricle. This should relieve the symptoms of congestive heart failure by allowing the failing left ventricle to eject its output with less work, thus preventing the accumulation of fluid in the lungs associated with congestive heart failure.

When positive pressure is applied to the lower part of the body during diastole, potential energy may be imparted to the arterial and venous vascular beds in that region.

In general, as diastole ends and systole begins, the release of external pressure through the aforementioned applicators may lower the blood pressure in the affected regions. This may cause blood to flow away from the upper part of the aorta. As a result, the vascular bed of the lower part of the body situated downstream may act as a passive pump, in series with the left ventricle. The application of additional external negative pressure by the present ELVAD device at the beginning of systole, may transform this passive pump into an active in series pump, which may be effective even in people with CHF who generally have diseased and inelastic peripheral arterial vessels.

BRIEF DESCRIPTION OF THE DRAWINGS

To these and to such other objects which may hereinafter appear, the present invention relates to an external counterpulsation cardiac assist device as described in detail in the following specification, recited in the annexed claims and illustrated in the accompanying drawings, wherein like numerals refer to like parts and in which:

FIG. 9 is a cross-sectional view showing a typical section of the shell of a fourth preferred embodiment of the present invention.

FIG. 10 is a side elevation view of a fifth preferred embodiment of the present invention.

DETAILED DESCRIPTION

Figure 1:
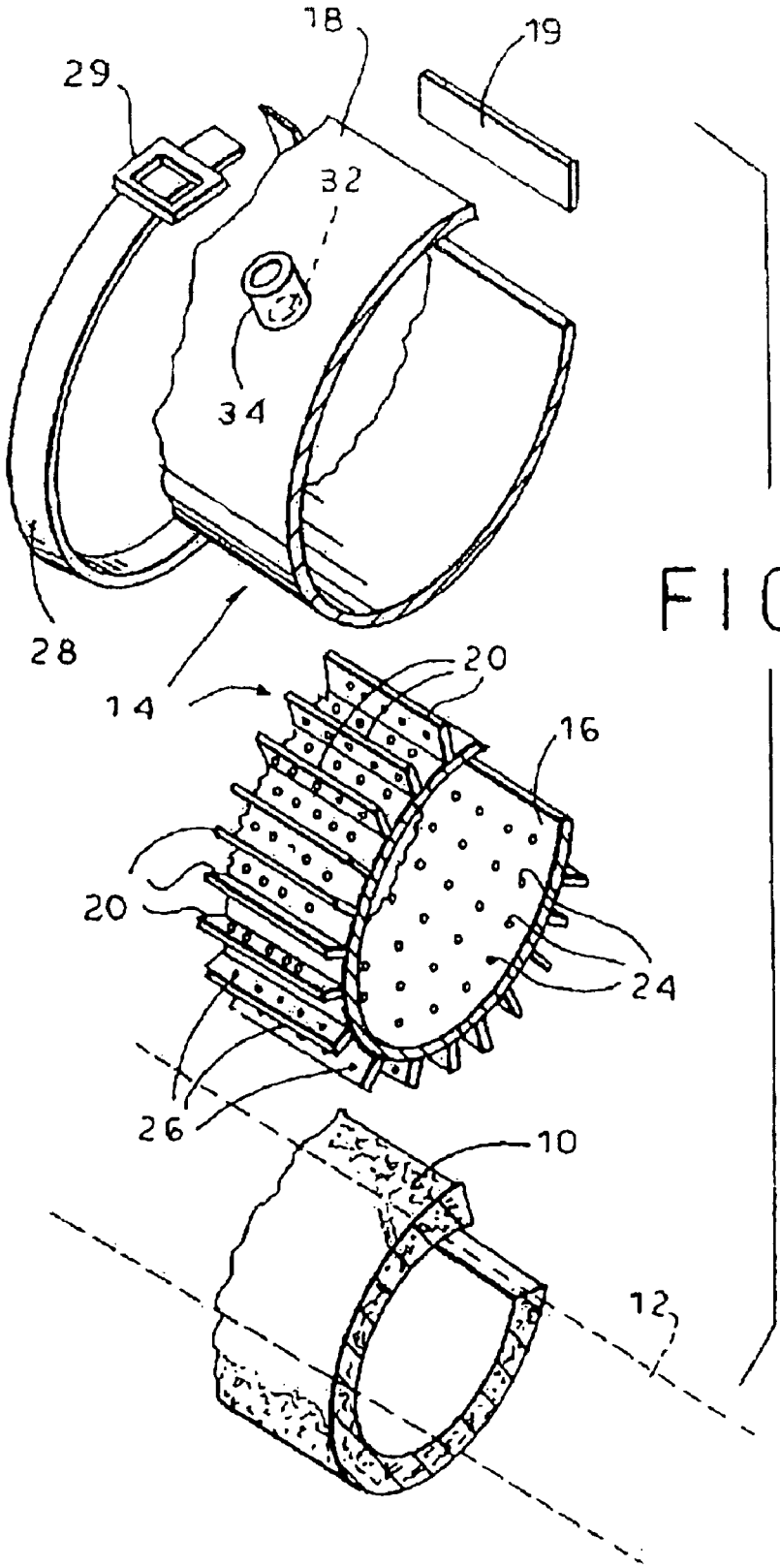
FIG. 1 is an exploded isomeric view of a typical section of a first preferred embodiment of the device housing.
Figure 2:
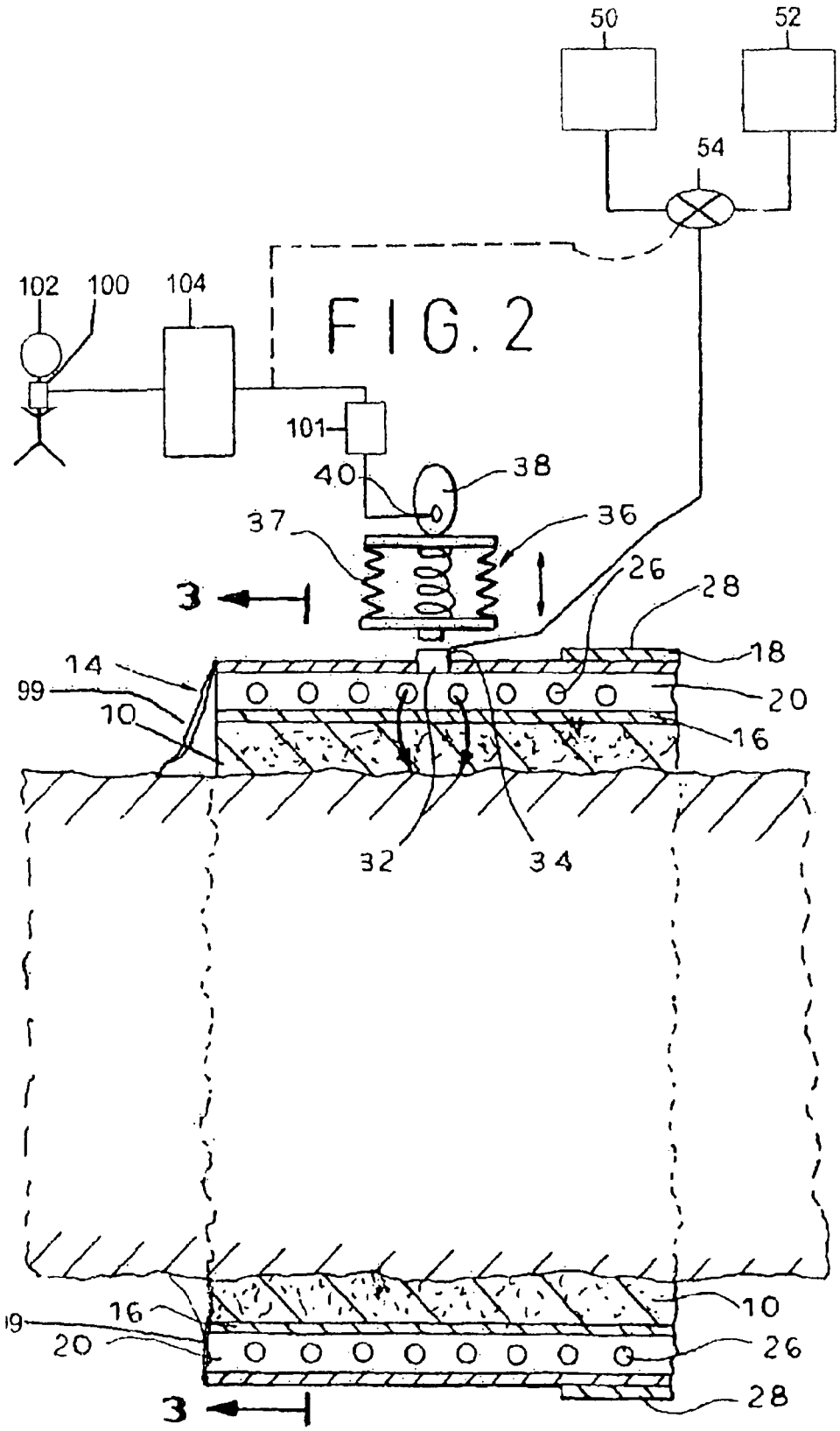
FIG. 2 is a cross sectional view of the housing of FIG. 1, as it would appear mounted on the limb of a patient.
Figure 3:
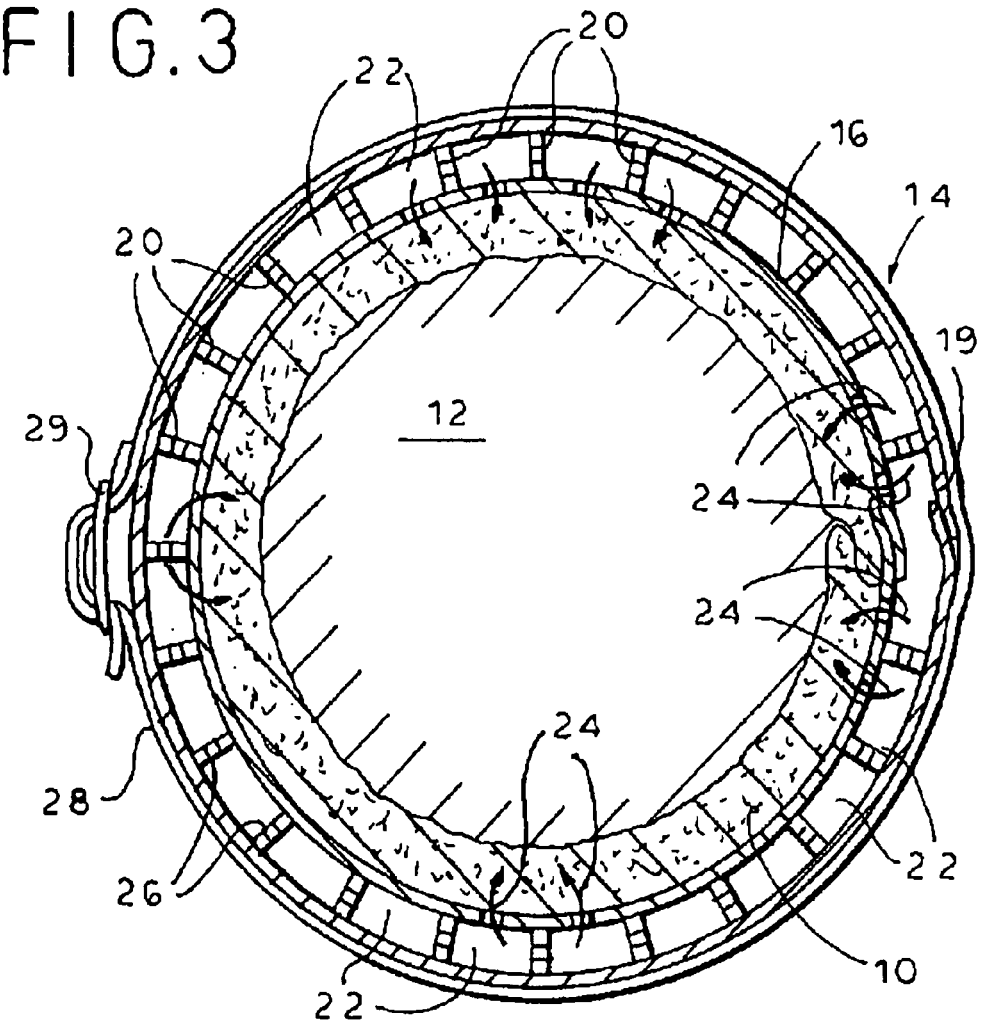
FIG. 3 is an isometric cross-sectional view taken along line 3-3 of FIG. 2.

The first preferred embodiment of the invention, as illustrated in FIGS. 1, 2 and 3, comprises a tube-like housing, a typical precut section of which is illustrated. The housing is adapted to be assembled in situ, and custom fitted to a limb, such as an arm or leg or to entire lower portion of the body, including the thighs and buttocks. The housing consists of a flexible, air permeable inner layer 10 composed of a sheet of fabric, felt or sponge-like material. Inner layer 10 is placed around the limb 12 and trimmed to size using a scissor or blade.

Around inner layer 10 is tightly fitted a hollow shell 14 which is initially deformable enough to closely conform to the contours of the limb. After shell 14 is sealed and secured in place around the limb as described below, it will become relatively rigid.

Shell 14 consists of an interior wall 16 and an exterior wall 18. Walls 16 and 18 are spaced apart by a plurality of upstanding spacer elements 20, so as to form an internal air distribution system defined by air flow chamber 22 between the shell walls.

Figure 4:
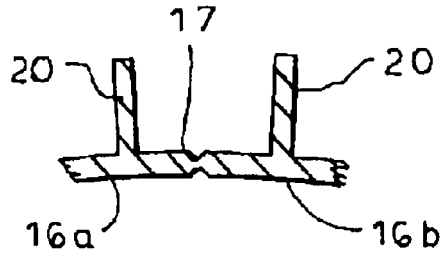
FIG. 4 is a cross-sectional view showing a portion of adjacent sections of the interior shell wall which are connected by a "living hinge."
Figure 5:
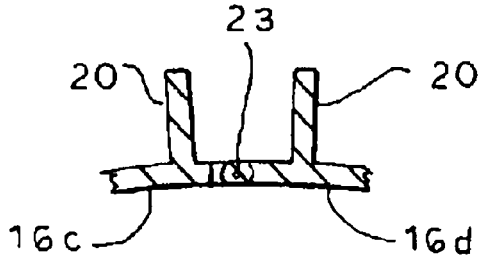
FIG. 5 is a view similar to FIG. 4 but showing a portion of adjacent sections connected by a hinge.

Interior shell wall 16 has a plurality of openings 24 which permit the free flow of air between chamber 22 and the shell interior. Openings 24 are arranged in a pattern which is determined by the configuration of the spacer elements. Wall 16 is relatively rigid particularly in the transverse and longitudinal directions. It can be formed of a single, initially deformable sheet of hard rubber or plastic 16, as shown in FIGS. 1, 2 and 3, or sections 16*a*, 16*b* of hard rubber or plastic connected by "living hinges" 17, as shown in FIG. 4, or sections 16*c*, 16*d* of metal connected by mechanical hinges 23, as shown in FIG. 5. If rubber or plastic, the sections of wall 16 can be provided flat and then deformed as required to fit snugly around inner layer 10.

Figure 7:
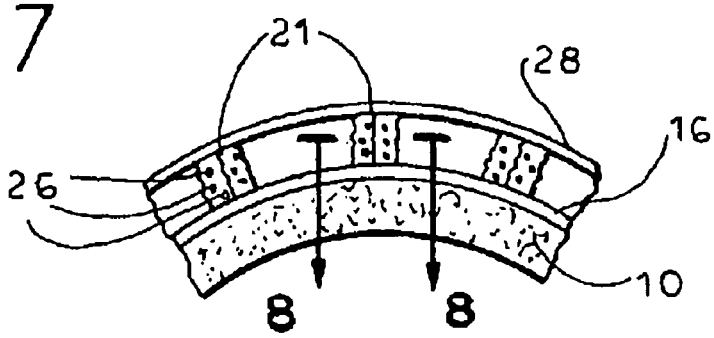
FIG. 7 is a cross-sectional view of a typical section of the shell of a third preferred embodiment of the present invention.
Figure 8:
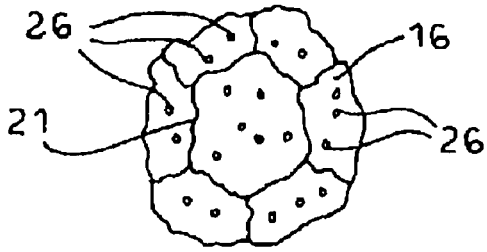
FIG. 8 is a cross-sectional view taken along line 8-8 of FIG. 7.
Figure 11:
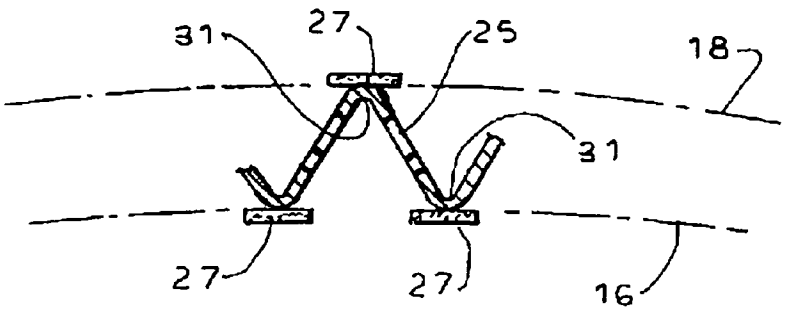
FIG. 11 is a cross-sectional view showing a typical section of the shell of a sixth preferred embodiment of the present invention.
Figure 14:
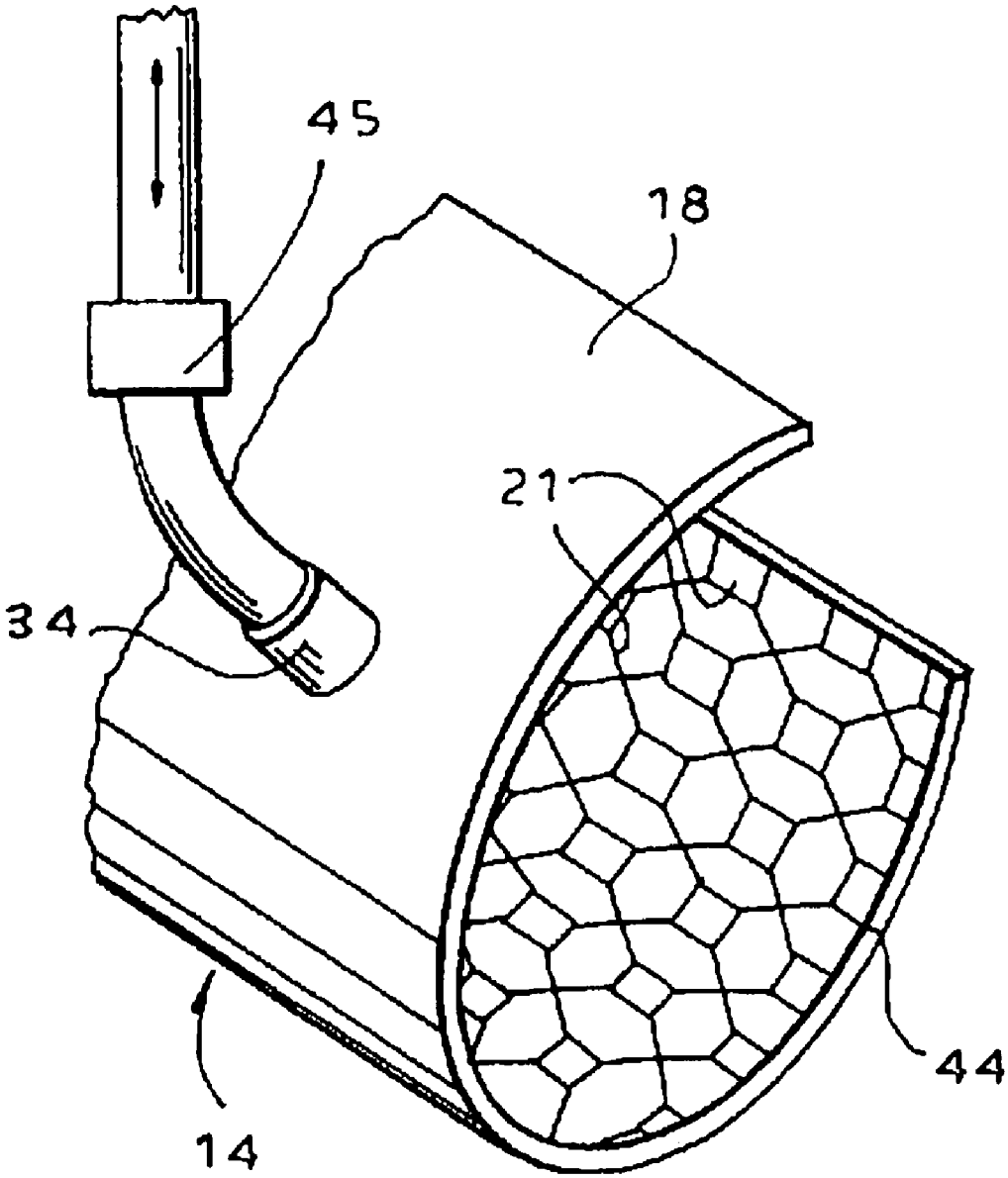
FIG. 14 is an isometric view of a fifth preferred embodiment of the present invention.

The spacer elements maintain the separation between the interior and exterior walls to insure free air flow throughout shell 14. These elements can take a variety of configurations, such as spaced, radially extending rectangular elements 20, as illustrated in FIGS. 1-6, honeycomb elements 21, as illustrated in FIGS. 7, 8 and 14, or spacer 25 with a bellows-like configuration, as illustrated in FIGS. 9 and 11. The spacer elements are preferably composed of the same material as wall 16. Whichever form of spacer elements is utilized, a plurality of air passageways 26 are provided through each spacer element such that the air will flow freely between the sections of chamber 22, defined by the spacer elements.

The spacer elements are preferably formed integrally with interior shell wall 16, as illustrated in FIGS. 1-6. However, in a situation where the elements are interconnected so they can stand alone as a unit, such as the honeycomb elements 21 of FIGS. 7, 8 and 14 or in the bellows-like spacer 25 of FIGS. 9 and 11, the spacer may be supplied in rolls or sheets, separately from wall 16. In that case, the spacer is trimmed appropriately and mounted over inner layer 10, if wall 16 is not present, as shown in FIG. 14 or over wall 16, after wall 16 is situated around inner layer 10. As illustrated in FIG. 11, hook and loop tape strips 27 can be used at the corners of spacer 25 in conjunction with hook and loop strips 31 on walls 16 and 18 to provide a more slip resistant fit relative to the shell walls.

The housing is completed by the installation of a relatively flexible (in bending) but non-extensible exterior wall 18, which is secured to hold the structure together tightly around the limb and sealed to provide an air tight seal, isolating the interior of the housing. Wall 18 is made of flexible material, such as plastic, reinforced plastic, fabric or the like or elastomer sheets of sufficient thickness (stiffening) to withstand the pressure changes which will be applied to the housing, minimally deform during this process and to maintain the tight fit of the housing.

Wall 18 may be supplied on rolls or in sheets and is trimmed as required. It is then placed tightly over the interior wall and spacer assembly. The edges of wall 18 are overlapped and sealed to each other to form an air tight joint using hook and loop tape or by strips of adhesive sealing tape 19 or the like. The ends of the housing are likewise sealed to the limb by adhesive sealing tape 99 or other conventional means such as clamps or belts to prevent air from escaping.

Belts or straps 28 are also used to encircle the housing at various locations along its length and are tightened to maintain the secure fit of the housing. This causes the shell to become sufficiently rigid to withstand the rapid pressure changes. Belts or straps 28 are flexible in bending but relatively inextensible and may have buckles or other fastening means 29. Hook and loop tape can be used to secure the exterior wall or to make the inner wall slip resistant.

Figure 6:
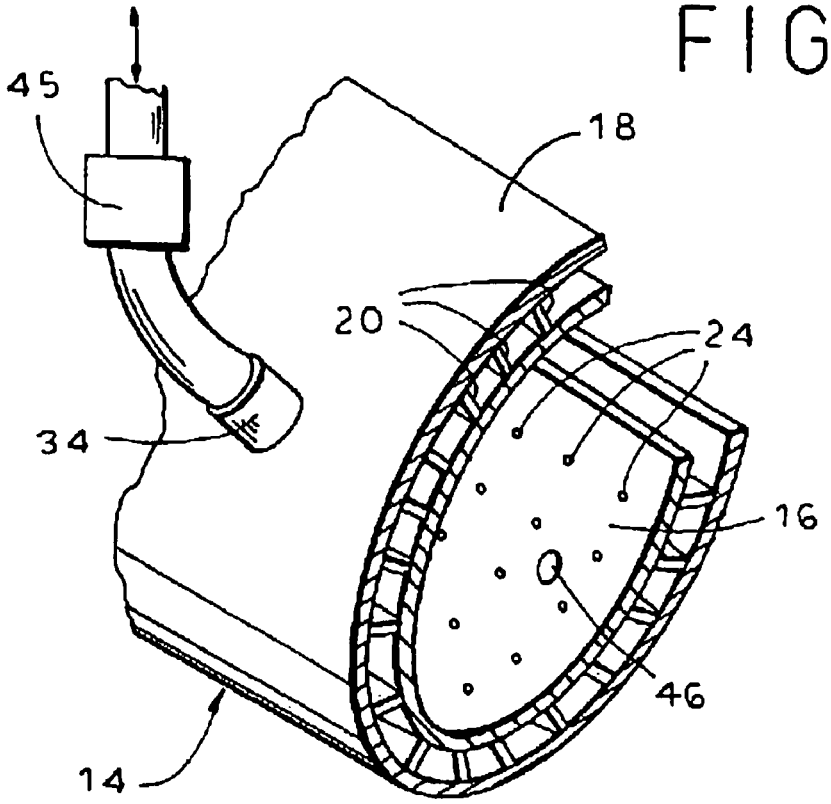
FIG. 6 is an isometric view of a typical section of the shell of a second preferred embodiment of the present invention.

FIG. 6 illustrates a preferred embodiment of shell 14' in which the walls 16, 18 and spacer elements 20 are all integral, such that the shell 14' is a unitary structure. In this case, the shell 14' is initially deformable and may be provided on a roll or in sheet form. Shell 14' is then cut and trimmed appropriately, wrapped around the inner layer 10, sealed and secured.

Instead of providing the shell in rolls or sheets, it is, possible to provide it in sections, each several, inches wide, which are individually fitted around the inner layer surrounding the limb, adjacent to each other, in side by side relation, transverse to the axis of the limb. The sections are sealed together with sealing tape and secured with belts or straps 28, as necessary. The transverse sectional embodiment is illustrated in FIG. 10, which shows a shell formed of a plurality of contiguous shell sections 14*a*, 14*b*, 14*c* and 14*d* extending transverse to the axis of the limb. Using transverse shell sections in this manner permits even greater conformity to the shape of the limb and greater flexibility with regard to the length of the housing.

Figure 13:
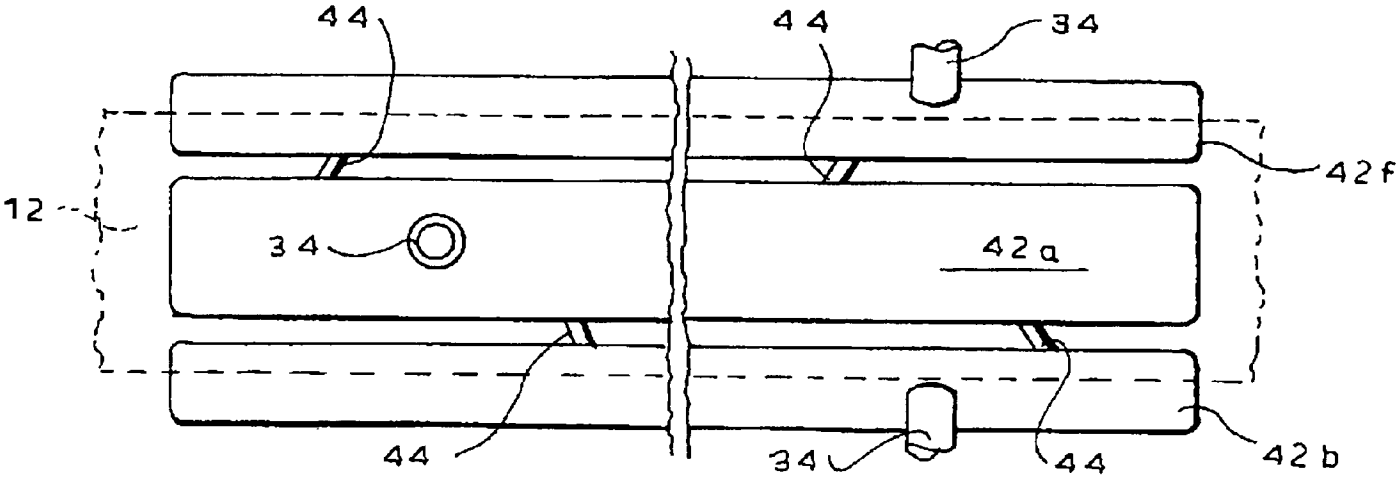
FIG. 13 is an elevational view of the embodiment illustrated in FIG. 11.
Figure 12:
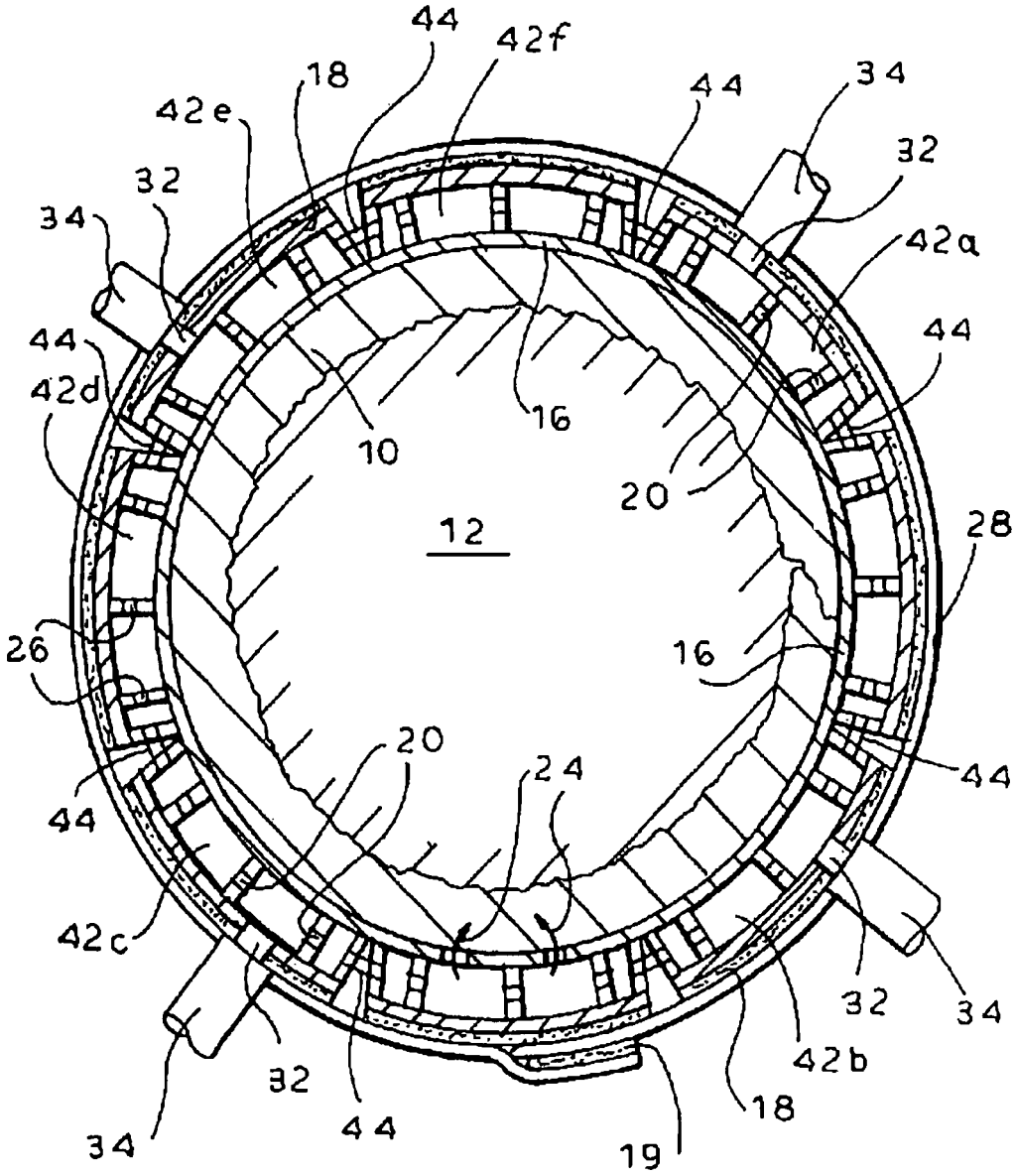
FIG. 12 is a cross-sectional view of a seventh preferred embodiment of the present invention.

FIGS. 12 and 13 illustrate another preferred embodiment of the present invention in which the shell is divided into longitudinal sections 42*a*, 42*b*, 42*c* . . . adapted to extend parallel to the axis of the limb 12. These sections are connected together by hinges, preferably "living hinges." As in the other embodiments, sections 42*a*, 42*b*, 42*c* . . . surround inner layer 10 of porous material which could be fabric, sponge-like or the similar materials. The inner wall 16 of each section 42 is provided with multiple air openings 24. Each section 42 includes spacer elements 20 such that internal air chambers 22 are formed. Sections 42*a*, 42*b*, 42*c* . . . are connected together by flexible tubes 44 to permit air to pass freely therebetween. A plurality of connectors 34 are provided for connection to the air source.

The sections 42*a*, 42*b*, 42*c* . . . are surrounded by belts or strips 28 to secure the housing around the limb and to render it relatively rigid. These securing means can be made of hook and loop tape or other inextensible fabric.

FIG. 14 illustrates the preferred embodiment of the shell 14 in which the inner layer 10 and the interior wall 16 are absent. Spacer means 21 are shown as honeycomb in configuration.

Air is moved into and out of internal shell chamber 22 thorough one or more ports 32 in exterior wall 18. Each port 32 is provided with a connector 34 of conventional design to permit a hose or conduit to be connected between the port and the air source.

As indicated above, the fluid used is preferably air, but could be other gases or even liquids, such as water. However, since the fluid must move in and out of the housing rapidly, a low viscosity fluid is preferred.

For some applications, compressed air from tanks 50 can be used for the application of positive relative pressure and the internal air chamber can simply be vented to relieve the pressure. However, if negative relative pressure is required, vacuum creating equipment 52 is needed. Tanks 50 and vacuum equipment 52 can be connected to the housing by suitable valving 54.

FIG. 2 illustrates, in schematic form, a pump 36 which could be used to supply to and remove air from the housing. Pump 36 includes air tight bellows 37 which contracts to push air into the internal, air flow chamber of the shell to pressurize the housing and expands to draw air out of the chamber to create a relative vacuum within the shell interior.

The expansion and contraction of the bellows is controlled by an off-center cam 38 which rotates on a shaft 40. Shaft 40 is driven by an electric motor 101, through a commonly used speed reduction and controlled clutch system to operate the pump in accordance with the signals sensed by an electrocardiograph or other heart function monitoring device 100 which may be coupled to a patient 102. Pump 36 is spring loaded toward the expanded condition of bellows 37 such that negative relative pressure (vacuum) is provided during each cycle. The appropriate valving (not shown) is provided between the pump and the housing ports, so as to feed air to the ports.

A microprocessor based computer device or system 104 may be coupled to the electrocardiograph or heart function monitoring device 100 and may receive information signals therefrom indicative of the patient's heart function or operation, such as information signals pertaining to cardiac diastole and cardiac systole. The computer system 104 may produce a control signal in accordance with the received cardiac diastole and cardiac systole information signals and supply the same to the motor 101 and/or the value 54 and/or other such device to control the flow of air into and/or from the housing in accordance with the cardiac diastole and cardiac systole of the patient 102.

In FIG. 2, for the sake of simplicity, the mechanism of affecting expansion and contraction of the bellows is shown to be by an off-center cam driven by an electric motor. However, any mechanism of producing linear motion by electric power, e.g., a lead screw mechanism, or a linear electric motor with appropriate motion transmission and controller, may also be used. In addition, since the positive relative pressure and relative vacuum generation periods are only a portion of the full cycle of operation of the system, the electric motor driving the pump can be used to store mechanical energy in the form of potential energy in the pump spring and in motor mounted flywheels. This would greatly reduce the size of the electric motor required to operate the pump.

The pump 36 shown in FIG. 2 is uniquely suited for use with the housing of the present invention because together they form a closed system in which the same air is moved back and forth between the pump and the housing as the bellows 37 expands and contracts. This permits the use of a smaller capacity pump and greater control over the temperature of the air within the housing. The smaller capacity pump permits the apparatus to be portable such that it can more easily be brought to a patient in an emergency situation. Of course, the capacity of the pump is determined by the size of the housing it is being used with.

Preferably, a heater element 45 and a temperature sensor 46 are employed to maintain the temperature of the air which is introduced into the housing at an elevated level, as shown in FIG. 6. Heat promotes vascular dilation and hence increased blood flow, resulting in an increase in the effectiveness of the device.

Other possible air sources could include a "double acting" pump, eliminating the need for the internal spring. Such a pump has the advantage of more accurate control over pressure levels and profiles. Piston pumps and rotary pumps could be used as well.

More than one air source could also be used. Multiple pumps, operating synchronously, may provide more uniform pressure application. The pumps could be set up to permit the system to operate at a higher number of cycles per second than a single pump. If used alternately, one pump or set of pumps could be compressing the air as the other forces the compressed air into the housing and visa versa.

Whatever type of air supply equipment is utilized, it is important to keep the volume of the shell interior and of the connection conduits to a minimum and the fit of the housing as close as possible to the contour of the limb. This reduces the volume of the space to be pressurized, the amount of air and vacuum required and hence capacity of the air supply pump.

It will now be apparent that the present invention relates to an external counterpulsation cardiac assist device including a sealed housing adapted to be assembled for custom fit and be mounted around the limb so as to provide positive and/or negative relative pressure in synchronization with heart function.

The housing includes an air permeable fabric-like inner layer surrounded by a relatively rigid but initially deformable shell. The shell includes an internal air flow distribution system defined between an initially deformable interior wall which can be made to snugly conform to the limb and a flexible exterior wall, separated from the inner wall by spacer elements so as to define an air flow chamber to facilitate the movement of air to and from the housing interior. The shell is sealed around the limb by adhesive sealing tape 99 or the like and secured tightly to the limb by belts, straps or the like.

The Present ELVAD Embodiments

A description of the various embodiments of the present invention and their method of operation will now be presented. In such description, one embodiment of the present invention will be described in detail and the other embodiments will then be described by pointing out their differences with the first embodiment.

Figure 15:
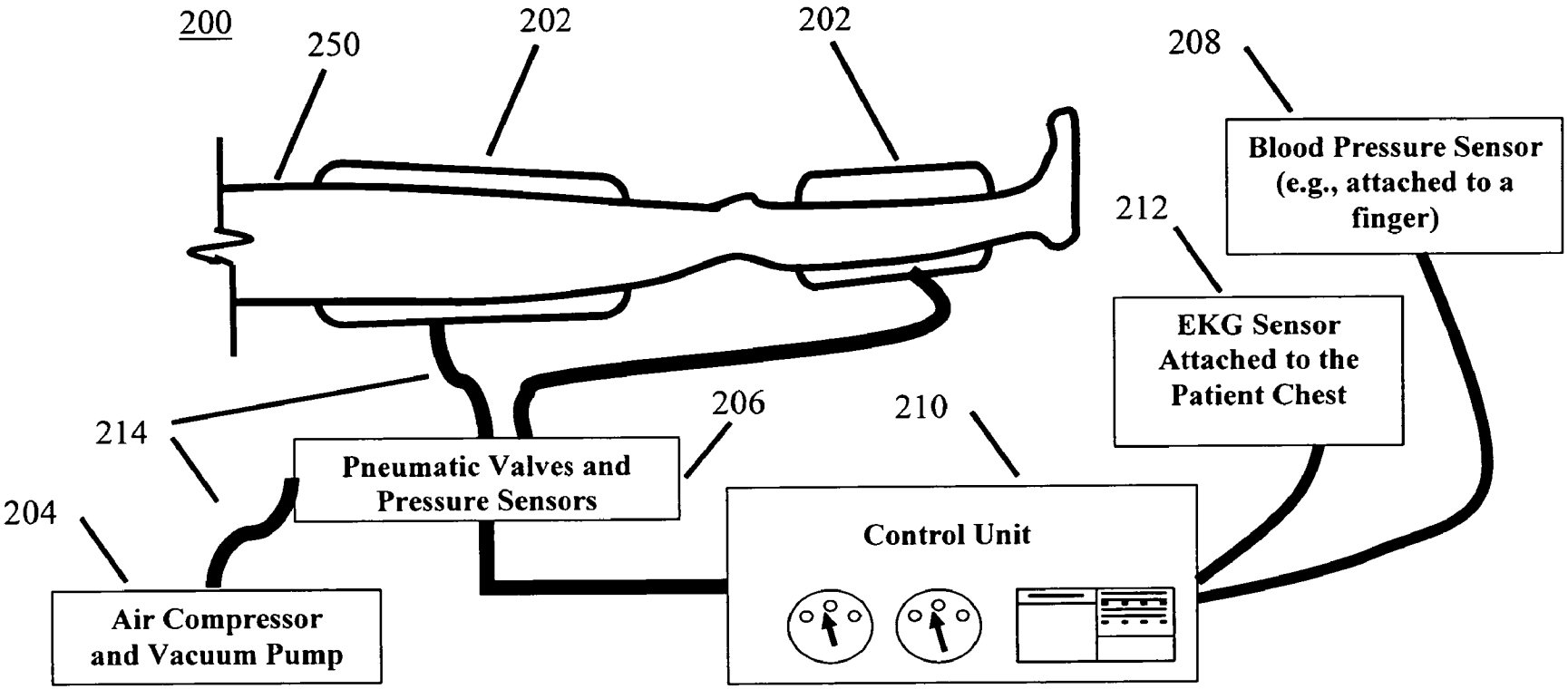
FIG. 15 is a schematic drawing of an external left ventricular assist device (ELVAD) device according to an embodiment of the invention.

A schematic drawing of an ELVAD device 200 according to an embodiment of the present invention which shows its major components is shown in FIG. 15. The device may include a number of positive and negative relative (gage) pressure applicators 202. Such applicators may be sealed housings with relatively rigid outer shells, which are adapted to be assembled and mounted around one or more limbs, such as the legs, thighs, and/or buttocks. The applicators may provide for positive relative pressure application and negative relative pressure (vacuum) application to the enclosed limb by pressurizing and developing a vacuum within the sealed interior of the housings.

An air compressor and vacuum pump 204 may be utilized to supply the pressurized air (or other gas) and vacuum to the applicators. Alternatively, a tank or other type of storage container having pressurized air (or other gas) may be used to supply the pressurized air. A system of electrically (or pneumatically, magnetically, etc.) activated valves 206, such as pneumatic valves, may provide the means to selectively supply pressurized air and/or vacuum to the specified applicator (s). The pneumatic valve system 206 may also allow the pressurized air to be discharged into a low-pressure stream to accelerate the rate at which the air is evacuated from the applicators and to reduce demand on the vacuum. Pressure sensors may be located in the feeding air hoses 214 and close to the applicator housings may be used to monitor and/or regulate the pressure/vacuum levels within each applicator. Pressure sensors 208 may also be used on the patient to determine the relative timing and the amount of reduction in the systolic and increase in the diastolic pressures during the operation of the system. The latter information may be used to manually and/or automatically adjust the amount of positive and/or negative pressures and their relative timing with respect to the heart beat.

A programmable microprocessor-based control unit 210 may control the operation of the ELVAD system. An EKG (electrocardiogram) signal 212, preferably assisted with the blood pressure measurement sensor 208 (usually attached to one finger of the patient) may provide the timing information to the control unit for applying alternating positive and negative relative pressure to the applicators in the manner previously described. The programmable microprocessor based control unit 210 may be constructed in a variety of different architectures and as one or more units. For example, in one embodiment of the present invention a personal computer (PC), such as a lightweight and portable version such as a laptop type, may be used together with a programmable control unit that runs the pneumatic system allowing the PC to be used to set the system parameters and collect and display data. The PC may have an interactive touch screen for the operator to set the operational parameters such as pressure levels, etc., and to choose to display data such as actual blood pressure in real time as measured by one or more (preferably finger attached) sensors. Other control knobs such as one to shift timing in the positive and negative pressure applicator(s) and their levels may be provided for ease of operation of the machine. At least one easy to activate and reach emergency button that instantly deactivates the pneumatic system and relieves all pressures from the applicators may also be provided. As is to be appreciated by those familiar with the controls art that a large number of variations may be possible in the design of such a control unit and its architecture and the description provided herein does not exclude any such control system hardware and operating architecture design.

The present inventors have described a number of designs for the applicator in U.S. Pat. No. 6,846,294 issued Jan. 25, 2005, and any one of these applicator designs may be used in the present embodiments being described herein. One applicator embodiment is shown schematically in FIG. 16.

Figure 16:
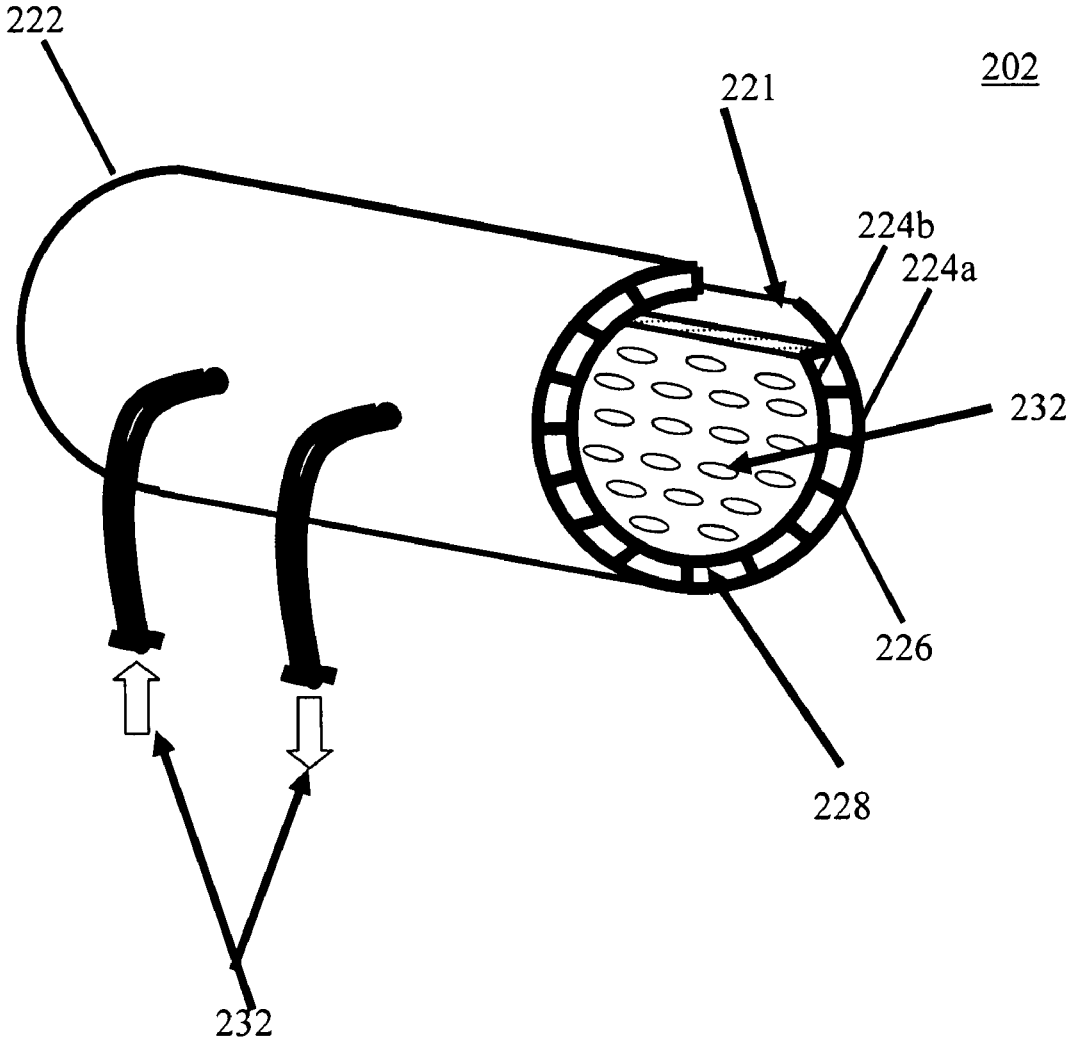
FIG. 16 is a schematic drawing of a positive and negative pressure applicator according to an embodiment of the invention.
Figure 17:
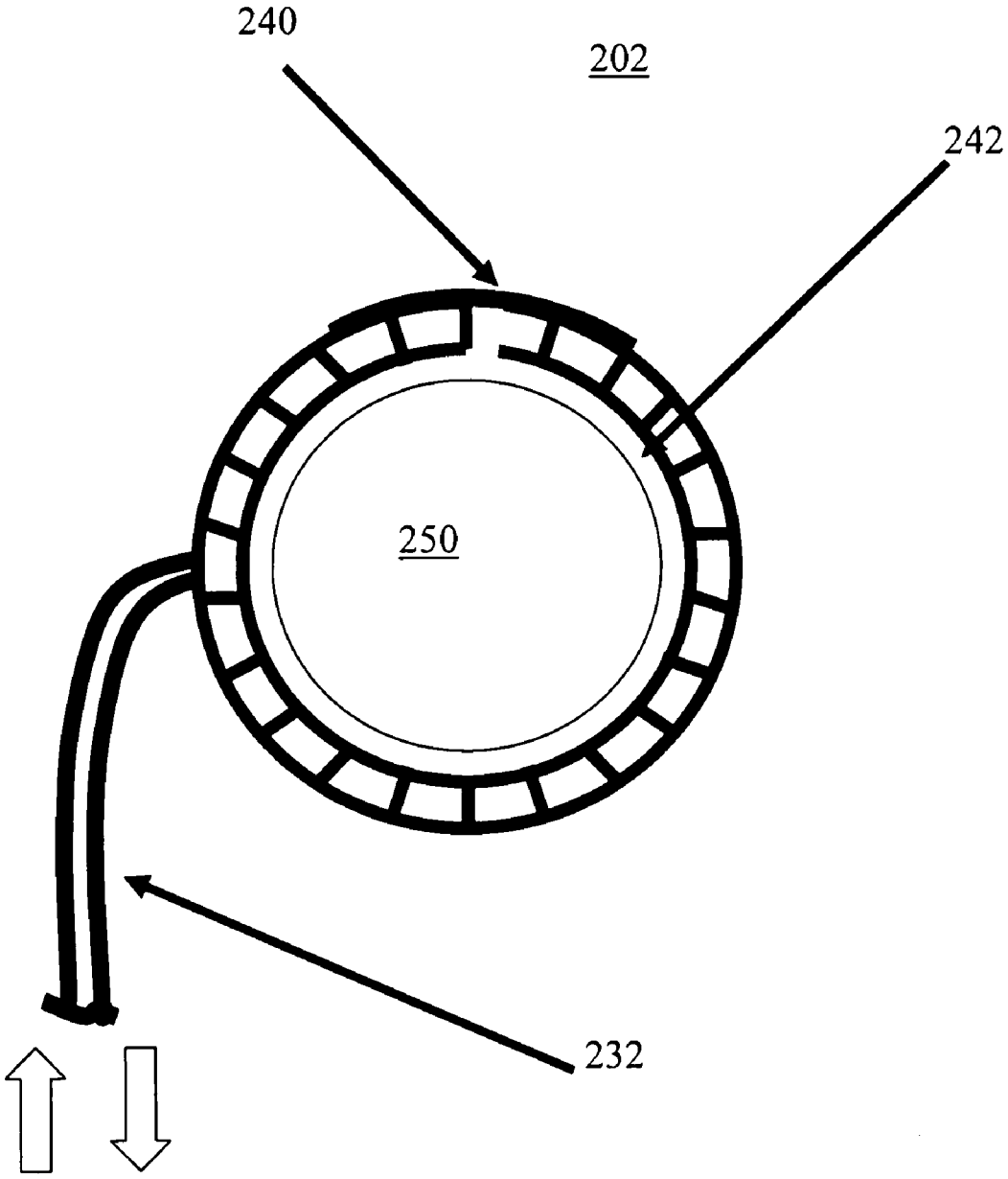
FIG. 17 is a schematic drawing of the assembled positive and negative pressure applicator according to an embodiment of the invention.

As shown in FIG. 16, the applicator 202 may include a tube-like housing 222 with a double-wall shell 224*a* and 224*b*, separated by spacing elements 226 to form internal air passages 228. The internal air passages may be connected to each other laterally through the holes provided through the spacer elements. The double-wall shell of the applicator may be sufficiently rigid so that once secured around a limb, it could withstand the application of positive pressure and not collapse as a result of the application of negative (vacuum) pressure. In one embodiment of the present invention, the applicator housing may be cut from flat (such as extruded) sheets, and assembled in situ, and custom fitted to the intended limbs. Overlapping the sealing extension at the open seam (FIG. 16) and sealing the seam using a sealing strap 240 (as shown in FIG. 17), may complete the assembly. The distal and proximal ends of the housing may then be sealed to the limb 250 using sealing tapes or other sealing devices. The high and low-pressure hoses 232 may then be attached to the outer wall of the housing at provided attachment points. To facilitate the flow of air throughout the enclosed chamber between the inner wall of the housing and the limb surface, air supply holes 232 may be provided throughout the wall surface as shown above, in FIG. 16.

To keep the central positioning of the limb within the housing chamber, an inner layer of a highly permeable "sponge" type of material 242 may be situated within the shell interior, adjacent to the limb as shown in FIG. 17. The inner layer may provide support to the limb, while minimally impeding the flow of air within the enclosed chamber between the limb surface and the inner wall of the applicator housing.

Due to the inherent design characteristics of the proposed applicator and since the applicator may be custom fitted to the limb, a relatively large or considerable amount of air volume may not be utilized during operation. If the amount of air that is displaced is not an issue (generally the higher the amount of air translates into a larger air compressor and/or vacuum pump, when present), then the custom fitting step may be eliminated. The applicators may also be designed in several sizes to minimize the amount of air that is used when operating the system. In addition, the amount of air used to operate the system can be significantly reduced by allowing the system to apply the positive-negative pressure cycle during one heart cycle and skip one or more heart cycles before applying it again.

The performance of the ELVADs of the present invention may be improved by applying negative pressure to the applicators in a sequential predetermined order such as to the applicator(s) attached to the buttock, then the applicator(s) attached to the thighs and then the applicator(s) attached to the legs; and/or applying positive pressure in a sequential predetermined order to the same applicators such as in an order opposite to that utilized in applying the negative pressure.

By minimizing the volume of the air utilized during operation, the present ELVAD system can be configured to be relatively small and lightweight, thereby capable of being portable and suitable for use at home, in an ambulance, in offices, and at the patient bedside in hospitals. The present system should also be relatively inexpensive to produce and operate and need minimal maintenance. For the case of home usage, the patient data may be readily transmitted to the attending physician and/or a central monitoring facility via internet or telephone line or other type of transmission medium or by wireless means. The data may also be centrally monitored by health professionals such as by way of an online arrangement via the internet. In addition, the health professionals may be able to adjust the parameters of the system, such as the positive and negative pressure levels, remotely by way of the internet, telephone lines, or other types of transmission medium or by wireless means. As is to be appreciated, in these latter situations, a remote monitor and/or control device such as a computer type device and a display unit may be utilized which may be configured by software or hardware to monitor and/or control the present system.

In addition, the EKG and blood pressure sensor data may be collected for each patient and analyzed over short and long periods of time to determine the level of improvement over time, to determine the levels of adjustment to the operating parameters of the machine such as the levels of positive and negative pressures and timings, etc., to best fit the conditions of each patient.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of treating congestive heart failure (CHF) in a patient, said method comprising:

arranging at least one pressure applicator externally around a body segment of the patient;

applying negative pressure, relative to atmospheric pressure, to the body segment of the patient during cardiac systole using the at least one pressure applicator, thereby reducing ventricular afterload in the patient; and removing the negative pressure to the body segment of the patient during cardiac diastole, wherein at least one said pressure applicator includes at least one housing adapted to surround the body segment of the patient, said at least one housing having a shell that includes an interior wall, an exterior wall, and a plurality of spacer elements configured to maintain said exterior wall in spaced relation with said interior wall, said plurality of spacer elements providing a plurality of air transfer openings that permit air flow between said exterior wall and said interior wall; and wherein said arranging step includes arranging said at least one housing around the body segment of the patient.

2. A method according to claim 1, wherein the negative pressure is substantially in the range of −30 to −50 mm Hg.

3. A method according to claim 1, wherein said arranging step includes arranging the at least one pressure applicator externally around a calf, a thigh or a buttock muscle of the patient.

4. A method according to claim 1, wherein said arranging step includes arranging a first pressure applicator externally around one of a calf, a thigh or a buttock muscle of the patient and arranging a second pressure applicator externally around another of the calf, the thigh or the buttock muscle of the patient, the second pressure applicator being arranged further from the heart of the patient than the first pressure applicator, and said applying step includes:

applying the negative pressure during the cardiac systole using the first pressure applicator, and then applying the negative pressure during the cardiac systole using the second pressure applicator while maintaining the negative pressure using the first pressure applicator.

5. A method according to claim 4, wherein said step of removing the negative pressure includes:

removing, during the cardiac diastole, the negative pressure applied by the second pressure applicator while maintaining the negative pressure using the first pressure applicator, and then removing, during the cardiac diastole, the negative pressure applied by the first pressure applicator.

6. A method according to claim 4, wherein said step of removing the negative pressure includes:

applying, during the cardiac diastole, a positive pressure using the second pressure applicator while maintaining the negative pressure using the first pressure applicator, and then applying, during the cardiac diastole, the positive pressure using the first pressure applicator while maintaining the positive pressure using the second pressure applicator.

7. A method according to claim 1, wherein said arranging step includes arranging a first pressure applicator externally around one thigh of the patient, arranging a second pressure applicator externally around another thigh of the patient, arranging a third pressure applicator externally around one calf of the patient, and arranging a fourth pressure applicator externally around another calf of the patient, and said applying step includes:

applying a negative pressure to the thighs during the cardiac systole using the first and second pressure applicators, and then applying a negative pressure to the calves during the cardiac systole using the third and fourth pressure applicators while maintaining the negative pressure to the thighs using the first and second pressure applicators.

8. A method according to claim 7, wherein said step of removing the negative pressure includes:

removing, during the cardiac diastole, the negative pressure applied to the calves by the third and fourth pressure applicators while maintaining the negative pressure to the thighs using the first and second pressure applicators, and then removing, during the cardiac diastole, the negative pressure applied to the thighs by the first and second pressure applicators.

9. A method according to claim 7, wherein said step of removing the negative pressure includes:

applying, during the cardiac diastole, a positive pressure to the calves using the third and fourth pressure applicators while maintaining the negative pressure to the thighs using the first pressure applicator, and then applying, during the cardiac diastole, a positive pressure to the thighs using the first and second pressure applicators while maintaining the positive pressure to the calves using the third and fourth pressure applicators.

10. A method according to claim 1, wherein said arranging step includes arranging a first pressure applicator externally around one buttocks muscle of the patient, arranging a second pressure applicator externally around another buttocks muscle of the patient, arranging a third pressure applicator externally around one thigh of the patient, arranging a fourth pressure applicator externally around another thigh of the patient, arranging a fifth pressure applicator externally around one calf of the patient, and arranging a sixth pressure applicator externally around another calf of the patient, and said applying step includes:

applying a negative pressure to the buttocks muscles during the cardiac systole using the first and second pressure applicators, and then applying the negative pressure to the thighs during the cardiac systole using the third and fourth pressure applicators while maintaining the negative pressure to the buttocks muscles using the first and second pressure applicators, and then applying a negative pressure to the calves during the cardiac systole using the fifth and sixth pressure applicators while maintaining the negative pressure to the buttocks muscles and to the thighs using the first, second, third and fourth pressure applicators.

11. A method according to claim 10, wherein said step of removing the negative pressure includes:

removing, during the cardiac diastole, the negative pressure applied to the calves by the fifth and sixth pressure applicators while maintaining the negative pressure to the buttocks muscles and to the thighs using the first, second, third and fourth pressure applicators, then removing, during the cardiac diastole, the negative pressure applied to the thighs by the third and fourth pressure applicators while maintaining the negative pressure to the buttocks muscles using the first and second pressure applicators, and then removing, during the cardiac diastole, the negative pressure to the buttocks muscles using the first and second pressure applicators.

12. A method according to claim 10, wherein said step of removing the negative pressure includes:

applying, during the cardiac diastole, a positive pressure to the calves using the fifth and sixth pressure applicators while maintaining the negative pressure to the buttocks muscles and to the thighs using the first, second, third and fourth pressure applicators, then applying, during the cardiac diastole, a positive pressure to the thighs using the third and fourth pressure applicators while maintaining the positive pressure to the calves using the third and fourth pressure applicators and while maintaining the negative pressure to the buttocks muscles using the first and second pressure applicators, and then applying, during the cardiac diastole, a positive pressure to the buttocks muscles using the first and second pressure applicators.

13. A method according to claim 1, wherein said step of removing the negative pressure during the cardiac diastole includes increasing the pressure applied to the body segment of the patient to atmospheric pressure.

14. A method according to claim 1, wherein said arranging step includes securing said at least one housing to the body segment of the patient using a sealing strap attached to an exterior of said shell.

15. A method according to claim 1, wherein said step of applying negative pressure includes removing air from between said plurality of spacer elements.

16. A method according to claim 1, further comprising: a resilient material attached to a surface of said interior wall and configured to contact the body segment of the patient.

17. A method according to claim 1, wherein said removing step includes applying a positive pressure, relative to atmospheric pressure, to the body segment of the patient during the cardiac diastole using the pressure applicator.

18. A method according to claim 17, wherein the positive pressure is substantially in the range of 50 to 100 mm Hg.

19. An apparatus for treating congestive heart failure (CHF) in a patient, said apparatus comprising:

at least one pressure applicator arranged externally around a body segment of the patient; and means for causing said at least one pressure applicator to apply negative pressure, relative to atmospheric pressure, to the body segment of the patient during cardiac systole, thereby reducing ventricular afterload in the patient, and for causing said at least one pressure applicator to remove the negative pressure to the body segment of the patient during cardiac diastole, wherein at least one said pressure applicator includes at least one housing adapted to surround the body segment of the patient, said at least one housing having a shell that includes an interior wall, an exterior wall, and a plurality of spacer elements configured to maintain said exterior wall in spaced relation with said interior wall, said plurality of spacer elements including a plurality of air transfer openings that permit air flow between said exterior wall and said interior wall.

20. An apparatus according to claim 19, wherein the negative pressure is substantially in the range of −30 to −50 mm Hg.

21. An apparatus according to claim 19, further comprising: means for causing said at least one pressure applicator to apply a positive pressure, relative to atmospheric pressure, to the body segment of the patient during the cardiac diastole.

22. An apparatus according to claim 21, wherein the positive pressure is substantially in the range of 50 to 100 mm Hg.

* * * * *